US005678841A

United States Patent [19]

Bauvois

[11] Patent Number: 5,678,841

[45] Date of Patent: Oct. 21, 1997

[54] SHELL SKIS HAVING LONGITUDINALLY OFFSET EDGE ELEMENTS

[75] Inventor: Jean Bauvois, Villard de Lans, France

[73] Assignee: Skis Rossignol S.A., France

[21] Appl. No.: 583,795

[22] Filed: Jan. 16, 1996

[30] Foreign Application Priority Data

Jan. 30, 1995 [FR] France ..... 95 01298

[51] Int. Cl.[6] ..... A63C 5/048

[52] U.S. Cl. ..... 280/608

[58] Field of Search ..... 280/608, 602

[56] References Cited

U.S. PATENT DOCUMENTS

| | | | |
|---|---|---|---|
| 2,743,113 | 4/1956 | Griggs | 280/11.13 |
| 3,095,207 | 6/1963 | Head | 280/11.13 |
| 3,776,563 | 12/1973 | Tigert | 280/11.13 |
| 4,636,009 | 1/1987 | Meatto et al. | 280/602 |
| 5,000,475 | 3/1991 | Gagneaux et al. | 280/602 |
| 5,002,300 | 3/1991 | Pascal et al. | 280/602 |
| 5,002,301 | 3/1991 | Cagneaux et al. | 280/602 |
| 5,033,765 | 7/1991 | Cagneaux et al. | 280/602 |
| 5,292,148 | 3/1994 | Abondance et al. | 280/602 |
| 5,458,358 | 10/1995 | Garcin et al. | 280/610 |

FOREIGN PATENT DOCUMENTS

| | | | |
|---|---|---|---|
| 0 510 308 A1 | 2/1992 | France | 280/602 |

*Primary Examiner*—Brian L. Johnson
*Assistant Examiner*—Bridget Avery
*Attorney, Agent, or Firm*—Parkhurst, Wendel & Burr, L.L.P.

[57] ABSTRACT

A pair of skis, of the type incorporating a shell, comprising, for each ski, at least one lateral reinforcing edge. The point of maximum height of the lateral reinforcing edge of the inner edge is offset forwardly or rearwardly with respect to a transverse line plane corresponding to all points of maximum height of the ski.

20 Claims, 5 Drawing Sheets

SHELL SKIS HAVING LONGITUDINALLY OFFSET EDGE ELEMENTS

FIELD OF THE INVENTION

The present invention relates to a pair of skis incorporating a so-called shell, such skis being equally well suited for alpine or downhill use, and provided with metallic lower edges, and or cross-country skis comprising or not comprising such metallic edges, each ski being furthermore provided, on at least one of its two lateral sides, with solid auxiliary reinforcing edges, which rest, directly or not, on the sole of the ski and which support the corresponding border of the shell.

BACKGROUND OF THE INVENTION

A transverse section made through an alpine ski of this type generally shows that it comprises at least:

- a lower sole for sliding, bordered on each side by metallic edges,
- a possible "lower" reinforcing layer which rests on this sole,
- a solid core which may for example be a core of wood or a core of polyurethane preferably obtained by a process of injection,
- solid auxiliary lateral edges forming longitudinal reinforcing elements, positioned on each side of this core and each resting on the corresponding metallic edge, and
- an upper shell made of plastics material, whose inner face is generally lined with an "upper" reinforcing layer and which covers the ski from one side to the other, abutting, on either side of the ski, on each of said solid auxiliary reinforcing edge elements.

The effect of these solid auxiliary reinforcing edge elements, which, in the prior art, were not part of the relatively novel concept of so-called "shell" skis, is to improve the efficiency of the ski with respect to an ordinary shell ski, in that they increase the efficiency of the transmission of the forces, exerted by the skier on the upper surface of the ski, to the lower lateral arrises of the ski, i.e. in fact to the sliding surface.

A cross-country ski, generally does not comprise metallic edges, but does comprise a lower lateral arris which, even if it is not a metallic edge, performs an important role, particularly for a ski intended for practising the "skating step". The solid auxiliary lateral reinforcing edge elements mentioned above likewise perform an appreciable role in improving the efficiency of the ski, in particular if used as a "skating ski".

It should be noted that, in traditional skis, i.e. those having substantially rectangular sections, the lateral edge elements with which a ski may be fitted always present a height which varies all along the length of the ski. In known skis, this height is maximum in the vicinity of the transverse line which defines the middle of the skier's boot in the so-called bearing zone and it decreases progressively on either side, i.e. on the one hand forwardly up to the beginning of the tip and on the other hand rearwardly towards the beginning of the tail.

On these skis, the variation in height of the lateral edge elements corresponds to the variation in thickness of the ski which is itself directly associated with the variation in flexural strength of the ski defining the distribution of the skier's weight on the snow.

On a ski of rectangular shape, this edge height therefore has a direct effect on the behaviour of the ski on snow.

For a ski of more modern shape as described hereinbefore, i.e. comprising a shell at least in the upper part and a conventional structure comprising at least one edge element in the lower part, the height of the edge element similarly influences the curve of stiffness of the ski on the one hand, and, on the other hand, has an effect on the efficiency of the bearing either on the lower metallic edge or more generally on the lower arris of the ski, but, in that case, the height of the edge element is no longer intimately associated with the thickness of the ski.

It should be noted that skis presently available, which comprise an upper shell bearing on an edge element or on a bead of constant height over the whole ski.

For an alpine or downhill ski, the metallic edges are intended to penetrate in the snow in order, after the fashion of a rail, to inscribe the ski in a curve.

To make a turn, the skier must therefore incline his skis with respect to the surface of the snow, bearing his weight on the ski outside the turn. It is therefore the inner edge of the outer ski which performs this role of rail during the whole turn.

For an alpine ski, the inner edges therefore perform a predominant role during turns.

Moreover, during at least the first part of the turn (start and steering), the weight of the skier's body is offset forwardly of the middle of the boot.

It should be noted that, on an alpine ski, the middle of the boot lies in the vicinity of the transverse line marking the point of maximum thickness of the ski.

For cross-country skiing according to the so-called "skating" technique, the skier moves about by causing his skis to diverge. This technique is essentially broken up into four successive phases, namely, respectively, a first phase during which the ski is in outer abutment, followed by a phase of sliding flat, followed in turn by a phase of impulse on the inner face and finally a so-called "flight" phase, during which the ski leaves the snow until the abutment of the following movement.

For practising "skating", unlike the so-called "classical" technique, or "alternate" step, the abutment on the lower arrises is considerable since, during the first phase, where the outer arris of the ski engages the snow, the weight of the skier's body is offset toward the rear of the ski, then, after a flat passage, the ski inclines again to place its inner arris in abutment on the snow as the impulse phase requires an energetic engagement, therefore a non-sliding point of abutment. In this phase, the skier's weight is offset in front of the point of maximum thickness of the ski.

It is an object of the present invention to improve the concept of introducing, in a ski incorporating a shell, solid auxiliary edge elements connecting, in the direction perpendicular to the sliding sole, the lower arrises to the respective lateral borders of the shell, such improvement aiming at optimizing the behavior of the ski.

SUMMARY OF THE INVENTION

To achieve the above object, each ski in a pair of skis, comprises at least:

- a lower sole for sliding, possibly bordered on each side by metallic edges,
- a possible lower reinforcing layer on this sole,
- a core,
- partly bordering this core on at least one of the sides of the ski, a solid auxiliary lateral edge element forming a longitudinal reinforcing element on this side, this edge element having a height varying lengthwise of the ski, this height presenting a maximum and decreasing progressively on either side of this maximum, an upper shell of plastics material, whose inner face is generally lined with an upper reinforcing layer and which covers the ski, bearing in particular on this or these solid lateral reinforcing edge elements, this pair of skis being characterized in that, for each ski of the pair, the point of maximum height of said lateral reinforcing edge element provided on at least one of the sides of the ski is offset longitudinally with respect to the transverse line which corresponds either to the point of maximum thickness of the ski, or to the centre of the longitudinal zone of the maximum thickness of the ski, instead of being conventionally located on this transverse line, such configuration being symmetrical, from one ski of the pair to the other, with respect to the longitudinal plane passing between each ski and constituting the median longitudinal plane of this pair of skis.

BRIEF DESCRIPTION OF THE DRAWINGS

The invention will be more readily understood on reading the following description with reference to the accompanying drawings, in which:

FIG. 2 is a side view of the right-hand ski of this pair, along II—II of FIG. 1.

DESCRIPTION OF PREFERRED EMBODIMENTS

Figure 1:
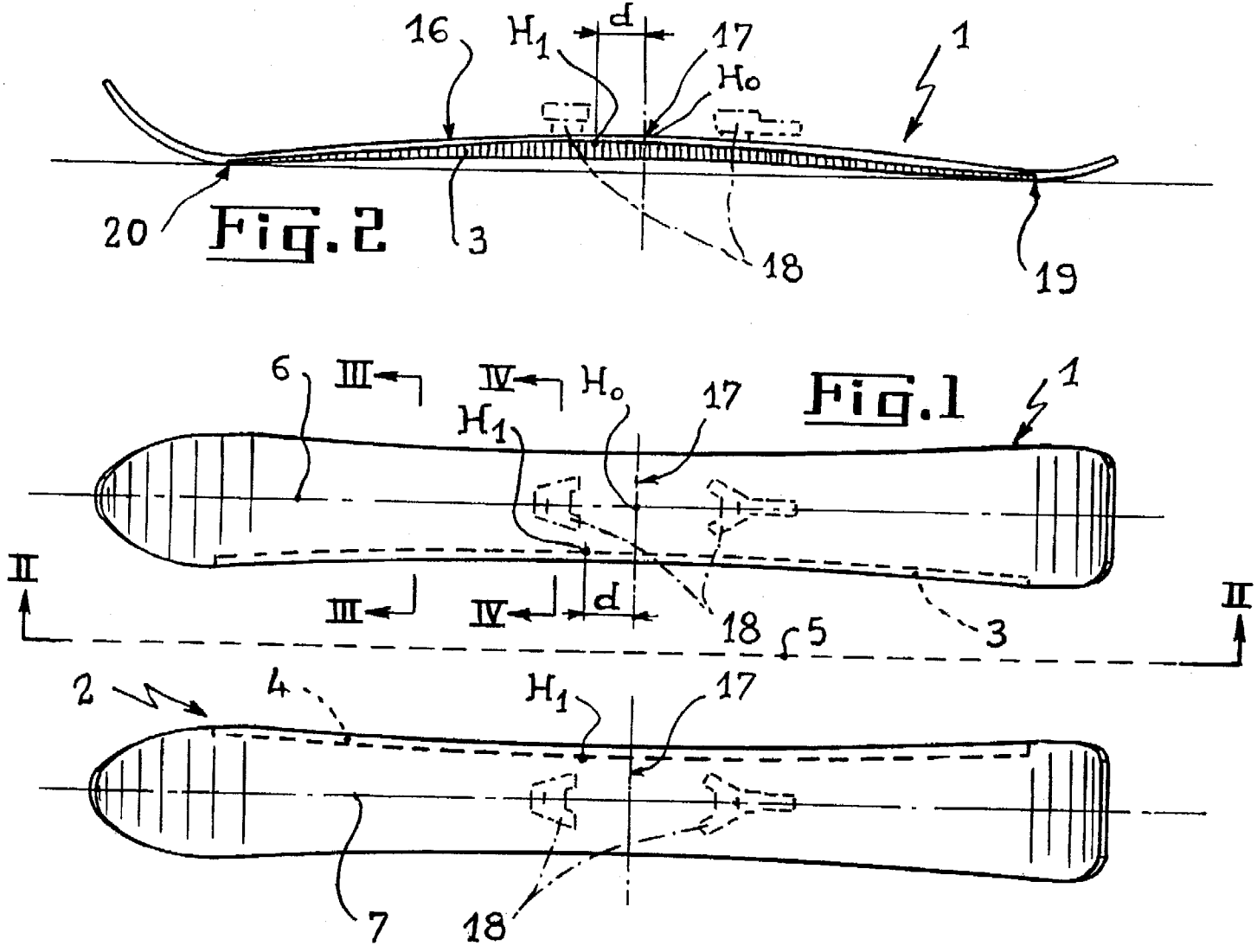
FIG. 1 is a plan view of a pair of downhill skis according to the invention.

Referring now to the drawings, FIGS. 1 to 4 firstly show a pair of downhill skis 1, 2 or "alpine skis" of the so-called "injected shell" type and each provided with a solid lateral reinforcing edge element 3, 4 on their inner edge.

When the two skis 1, 2 are placed flat and ready to be put on, as shown in FIG. 1, ski 1 is the right-hand ski and ski 2 the left-hand ski. These two skis 1, 2 are symmetrical to each other with respect to the longitudinal plane 5, perpendicular to the ground when the skis rest flat thereon, passing between each ski 1, 2 and constituting the median longitudinal plane of the pair, but they are each asymmetrical with respect to their own median longitudinal plane 6 and 7 respectively.

Figure 3:
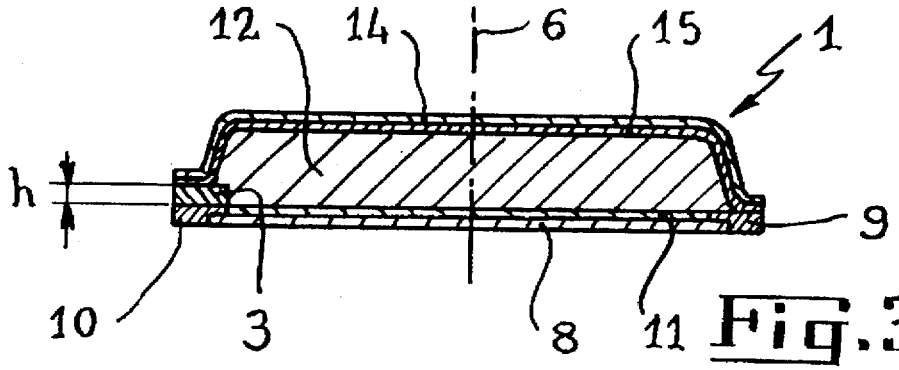
FIG. 3 is a transverse section along III—III of FIG. 1.
Figure 4:
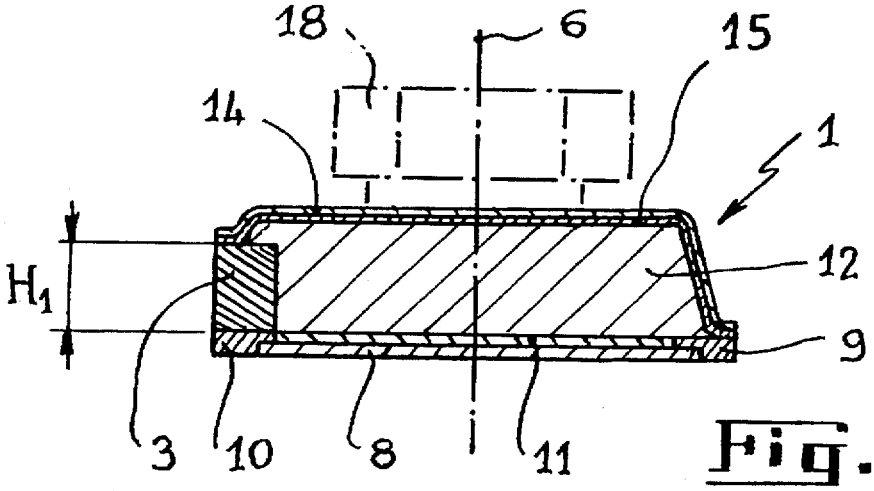
FIG. 4 is a transverse section along IV—IV of FIG. 1, and along IV—IV of FIG. 5.
Figure 7:
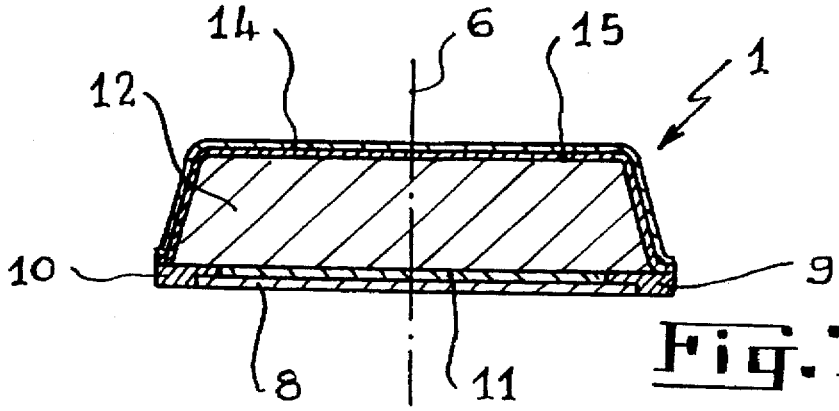
FIGS. 5, 6 and 7 are views respectively similar to FIGS. 1 to 3, but illustrating a second embodiment of the invention.
Figure 6:
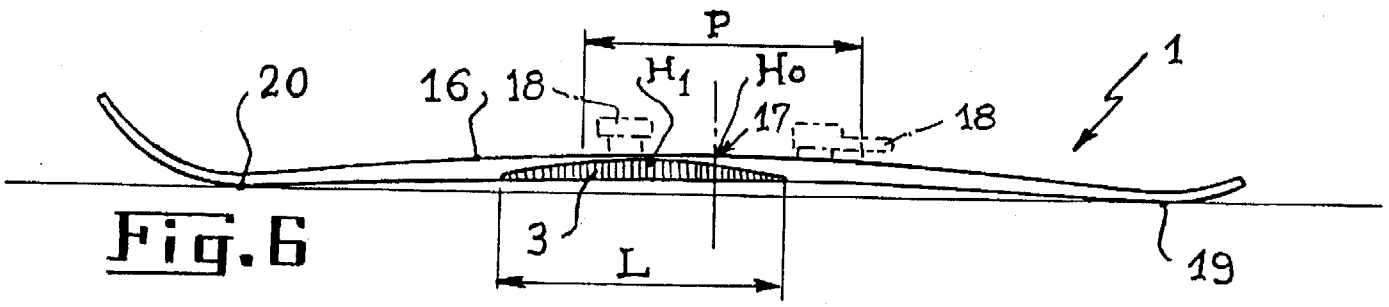
Figure 5:
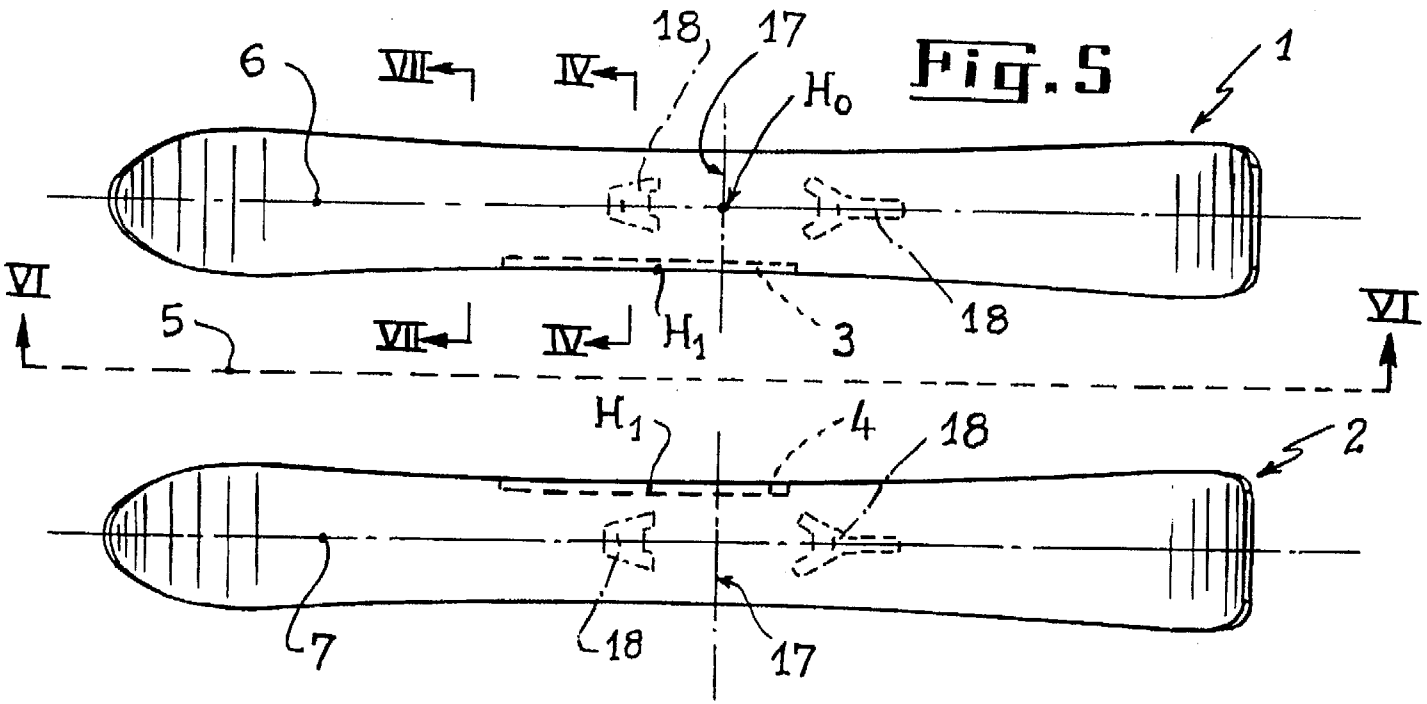
Figure 8:
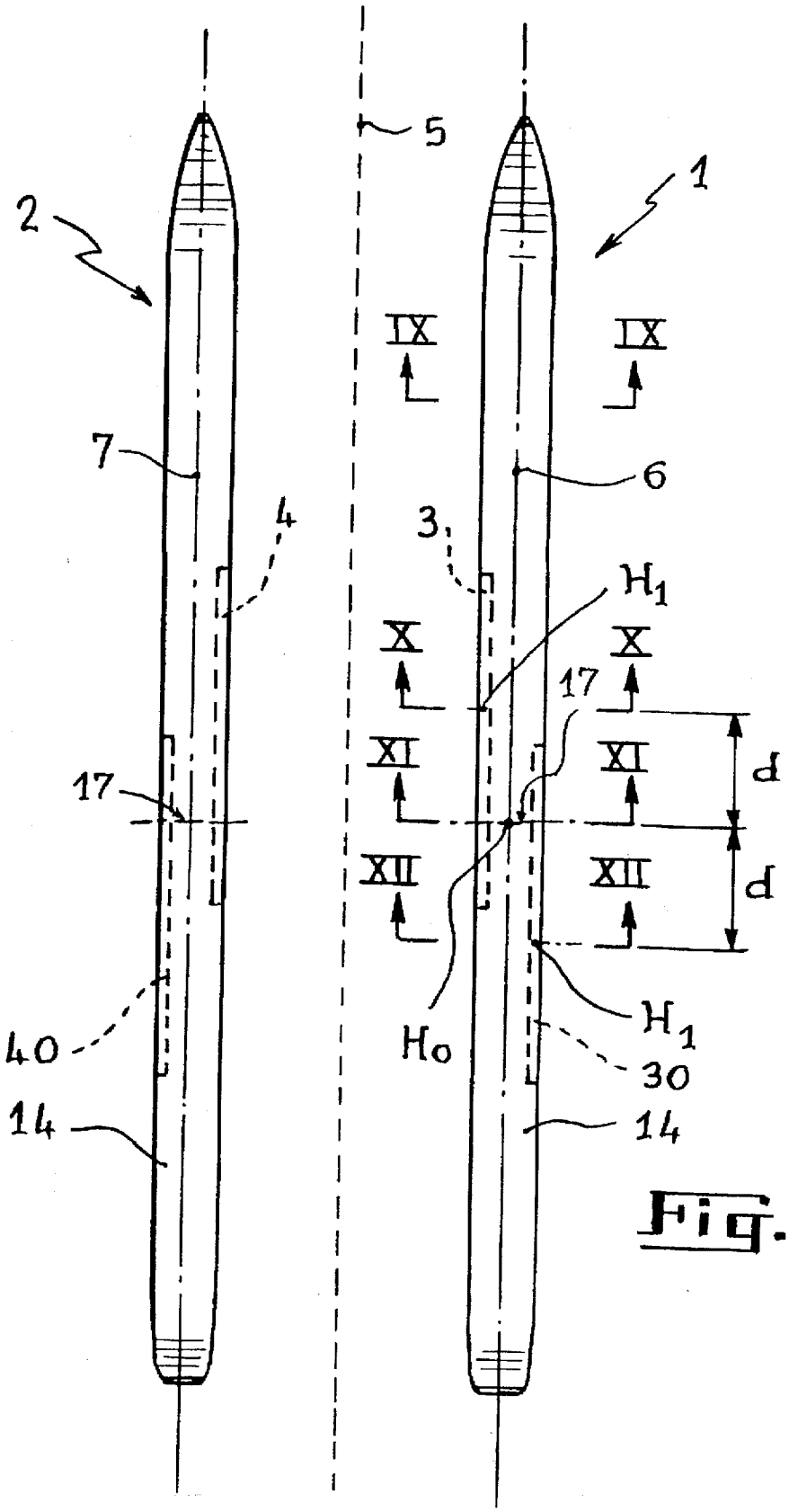
FIG. 8 is a plan view of a pair of langlauf skis in accordance with a third embodiment of the invention.

As shown in FIGS. 3 and 4, each ski of the pair (here, ski 1) comprises:

a lower sole 8 for sliding, bordered on each side by metallic edges 9, 10;

a lower reinforcing layer 11 which rests on the sole 8;

a polyurethane core 12 obtained by the presently conventional process of "in situ" injection of the compounds of a polyurethane foam;

bordering this core towards the inner edge 10 of the ski, there is a solid auxiliary lateral edge element 3 forming a longitudinal reinforcing element on this inner side of the ski and resting on the corresponding edge 10;

a shell 14 made of plastic material, of which the inner face is lined with an upper reinforcing layer 15 and which covers the ski, abutting on the one hand, on the reinforcing edge element 3 on the inner side of the ski and, on the other hand, on the outer edge 9 on the outer side of this ski.

Ski 1 conventionally presents a "line of thickness" 16, this thickness being maximum at a point Ho, this point being in fact either the possible effective point of maximum thickness, or the centre of the possible longitudinal zone of maximum thickness of the ski, at the level of a transverse line 17 which is close to the location of the middle of the skier's boot when it is in place between its bindings 18, and substantially the location of the middle of the bearing zone, and progressively decreasing on either side of this transverse line 17 of maximum thickness of the ski.

The same conventionally applies to a lateral edge element of the ski: this lateral edge element is of "height" h which varies all along the ski, this height h being normally maximum at a point H1, at the level of the line 17 of maximum thickness of the ski, and decreasing progressively on either side of this line.

As mentioned previously, and contrary to what happens for traditional skis of virtually rectangular section, the height h of each lateral edge element is no longer, for these shell skis, intimately connected with the thickness of the ski, as these lateral edge elements are surmounted by a shell of variable height. It is therefore possible, in such a structure and in accordance with the general means of the present invention, to envisage displacing the zone of maximum height of the edge element with respect to the zone of maximum thickness of the ski.

In accordance, therefore, with the invention, the point H1 of maximum height h of each of the lateral reinforcing edge elements 3 and 4 is offset forwardly of the ski with respect to the line 17 of maximum thickness of the ski, instead of being conventionally located on that line.

This offset "d" of point H1 with respect to line 17 is, for example on the order of 2 to 30 centimeters for a ski 2 meters long.

This arrangement improves engagement of the ski, and therefore control in a turn, as the skier's weight bears, on entering the turn, towards the front part of the inner edge of the ski outside the turn.

FIGS. 3 and 4 give an idea of the differences in height of the reinforcing edge element 3 in two different zones of the ski 1.

In this embodiment, the reinforcing edge elements 3 and 4 extend substantially all along the ski, from the line of rear contact 19 to the line of front contact 20.

Figure 9:
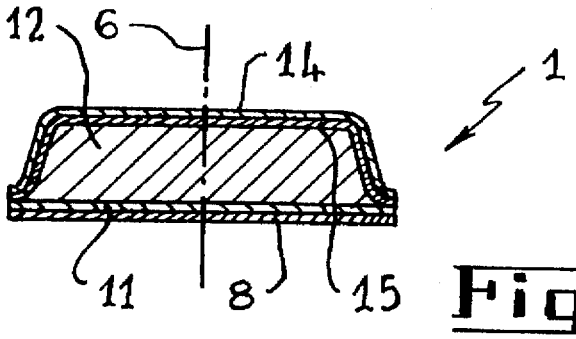
FIGS. 9 to 12 are, respectively, transverse sections along IX—IX, X—X, XI—XI and XII—XII of FIG. 8.
Figure 10:
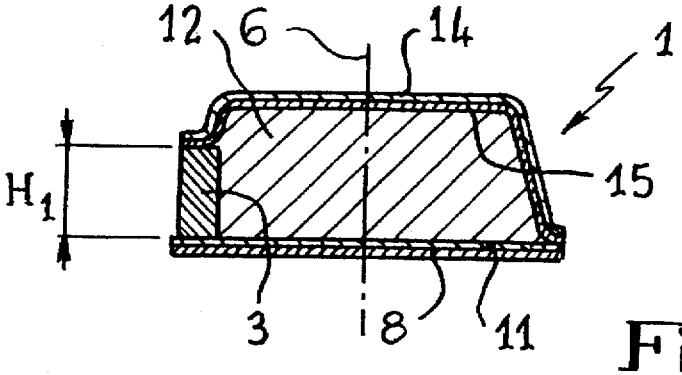
Figure 11:
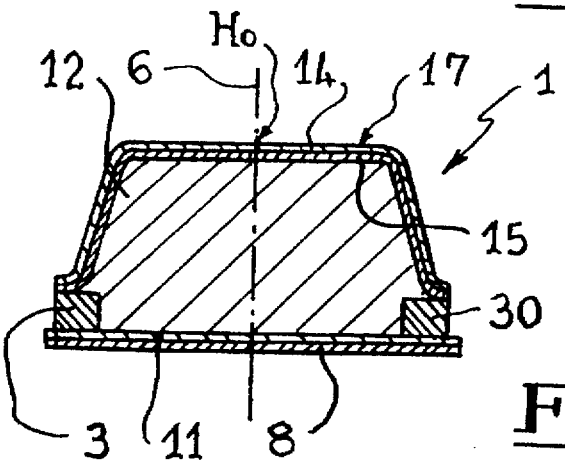
Figure 12:
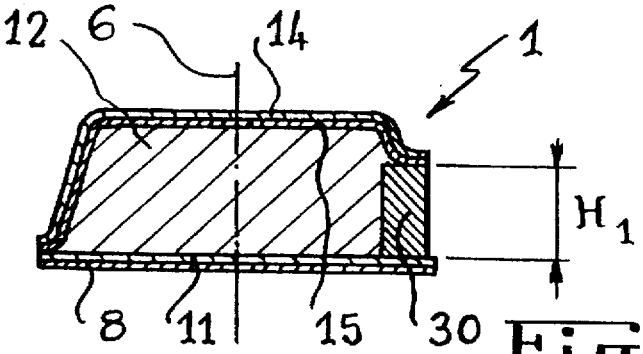

However, it is not compulsory, in accordance with FIG. 9 of Applicants' FR-A-2 683 734, for a reinforcing edge element to extend over the whole length of the ski, and, in this respect, FIGS. 5, 6, 4 and 7 illustrate, in the same manner as hereinbefore, a second embodiment, according to the invention, for which the reinforcing edge elements 3 and 4 extend over a restricted length L. In that case, the two edge elements 3, 4 are themselves offset forwardly, like point H1 of maximum height of each of these edge elements.

In this embodiment, the length L of these edge elements 3 and 4 is substantially equal to the length of the bearing zone P of which line 17 marks the middle.

By numerical example, each lateral edge element 3 or 4 has a length of the order on 40 cm for a ski 2 meters long, and its forward offset is such that the distance d is on the order of 10 to 20 centimeters.

It goes without saying that the invention is not limited to the two embodiments which have just been described. For example, each ski may also present a lateral reinforcing edge element on its outer edge or arris, which may in that case either be conventionally centered on the transverse line 17 of maximum thickness of the ski, and therefore have its point H1 of maximum height located on this line, or likewise have its point H1 of maximum height offset forwardly, by the same distance as the inner edge or not, or have its point of maximum height H1 offset rearwardly as will now be explained with reference to FIGS. 8 to 12 which apply, by way of non-limiting example, to a pair of cross-country skis not presenting lower metallic edges.

Referring now to FIGS. 8 to 12, which depicts of a pair of cross-country skis, and more precisely a pair of skis 1, 2 provided for practising the "skating" step.

This pair of skis presents, symmetrically with respect to the median longitudinal plane of the pair, solid auxiliary reinforcing edge elements 3, 4 on the inner side of each ski which, like for the alpine skis according to FIGS. 1 to 7, are similarly offset by "d" forwardly of the ski with respect to point Ho (or, in other words, with respect to the transverse line 17) of maximum height of the ski.

In addition, these cross-country skis 1, 2 present, here symmetically with respect to point Ho proper located on the transverse line 17 of the ski, reinforcing edge elements 30, 40 on the outer side of the skis 1, 2, these edge elements being identical to edge elements 3, 4, but being offset rearwardly by the same longitudinal distance d, instead of being offset forwardly.

Of course, it is not compulsory either for these edge elements 30, 40 to be identical to edge elements 3, 4, nor for them to be offset rearwardly by the same distance d as that by which edge elements 3, 4 are offset forwardly. Moreover, it is not even compulsory, in particular on a cross-country ski, for the edge elements 3, 4, which are offset forwardly, to exist. A ski according to the invention may very well have only rearwardly offset edge elements 30, 40, such edge elements being provided either on one side only of each ski, or on both sides and in that case present dimensions and/or longitudinal offsets identical or not to those of the edge element which equips the opposite side of the ski.

What is claimed is:

1. A ski, comprising:

a lower sole for sliding;

a core;

a solid lateral reinforcement element formed on at least one side of the ski bordering said core, said reinforcement element having a point of maximum height and a decreasing height on either side of said point of maximum height lengthwise along the ski; and an upper shell, comprising plastic material, covering the core and bearing on a top surface of said reinforcement element, wherein said point of maximum height of said reinforcement element is offset longitudinally with respect to all transverse planes passing through all points of maximum thickness of the ski.

2. The ski of claim 1, wherein the longitudinal offset of the point of maximum height of said reinforcement element with respect to one of said transverse planes of maximum thickness of the ski is about 20 to 30 centimeters.

3. The ski of claim 1, wherein said reinforcement element is of a substantially reduced length with respect to the length of the ski and is offset longitudinally towards one of the front and rear of the ski.

4. The ski of claim 1, wherein said reinforcement element is located on an inner side of the ski and is positioned such that the point of maximum height is offset towards the front of the ski.

5. The ski of claim 4, wherein the ski is an alpine ski.

6. The ski of claim 1, wherein the ski further comprises an inner side reinforcement element having its point of maximum height offset towards the front of the ski, and an outer side reinforcement element having its point of maximum height offset towards the rear of the ski.

7. The ski of claim 6, wherein the ski is a cross-country ski.

8. The ski of claim 1, wherein the lower sole of the ski comprises metal edges.

9. The ski of claim 1, further comprising a lower reinforcing layer abutting said sole.

10. The ski of claim 1, further comprising a reinforcement layer abutting an inner face of said upper shell.

11. A pair of skis, each ski of said pair of skis having the structure of the ski of claim 1, wherein the reinforcement elements in each of said skis are arranged symmetrically with respect to a vertical plane passing between the inner side of said skis lying horizontally side-by-side.

12. The pair of skis of claim 11, wherein the lower sole of each ski comprises metal edges.

13. The pair of skis of claim 11, wherein each ski further comprising a lower reinforcing layer abutting said sole.

14. The pair of skis of claim 11, wherein each ski further comprises a reinforcement layer abutting an inner face of said upper shell.

15. The pair of skis of claim 11, wherein the longitudinal offset of the point of maximum height of said reinforcement elements with respect to one of said transverse planes of maximum thickness of each ski is about 20 to 30 centimeters.

16. The pair of skis of claim 11, wherein said reinforcement elements are of a substantially reduced length with respect to the length of the skis and are offset longitudinally towards one of the front and rear of the skis.

17. The pair of skis of claim 11, wherein said reinforcement elements are located on the inner sides of the skis and are positioned such that their points of maximum height are offset towards the front of the skis.

18. The pair of skis of claim 17, wherein the skis are alpine skis.

19. The pair of skis of claim 11, wherein each of the skis further comprises an inner side reinforcement element having its point of maximum height offset towards the front of the ski, and an outer side reinforcement element having its point of maximum height offset towards the rear of the ski.

20. The pair of skis of claim 19, wherein the skis are cross-country skis.

* * * * *